US008534245B2

(12) United States Patent
Methley et al.

(10) Patent No.: US 8,534,245 B2
(45) Date of Patent: Sep. 17, 2013

(54) ASSEMBLY OF A VALVE OPERATING SYSTEM INCORPORATING A CAM SUMMATION MECHANISM

(76) Inventors: Ian Methley, Witney (GB); Edward Hughes, Oxford (GB)

( * ) Notice: Subject to any disclaimer, the term of this patent is extended or adjusted under 35 U.S.C. 154(b) by 0 days.

(21) Appl. No.: 13/698,663

(22) PCT Filed: May 11, 2011

(86) PCT No.: PCT/IB2011/052076

§ 371 (c)(1), (2), (4) Date: Nov. 18, 2012

(87) PCT Pub. No.: WO2011/148293

PCT Pub. Date: Dec. 1, 2011

(65) Prior Publication Data

US 2013/0061824 A1 Mar. 14, 2013

(30) Foreign Application Priority Data

May 26, 2010 (GB) ..... 1008766.6

(51) Int. Cl.
*F01L 1/34* (2006.01)

(52) U.S. Cl.
USPC ..... 123/90.16; 123/90.27; 123/90.45

(58) Field of Classification Search
USPC ..... 123/90.16, 90.27, 90.39, 90.4, 90.44, 123/90.45, 90.15
See application file for complete search history.

(56) References Cited

U.S. PATENT DOCUMENTS 7,123,456 B2 10/2006 Kamata et al.

FOREIGN PATENT DOCUMENTS

| | | |
|---|---|---|
| EP | 1417399 | 5/2004 |
| EP | 2093391 | 8/2009 |
| EP | 2242912 | 10/2010 |
| EP | 2257697 | 12/2010 |
| GB | 2458947 | 10/2009 |
| WO | WO03/016684 | 2/2003 |
| WO | WO2008/139221 | 11/2008 |
| WO | WO2009/122196 | 10/2009 |

OTHER PUBLICATIONS

PCT written opinion in parent application PCT/IB2011/052076.

*Primary Examiner* — Kenneth Bomberg
*Assistant Examiner* — Wesley Harris
(74) *Attorney, Agent, or Firm* — Shalom Wertsberger; Saltamar Innovations

(57) ABSTRACT

A method is disclosed for assembling a valve operating system for opening and closing a poppet valve mounted on an engine cylinder head. The valve operating system comprises a camshaft 18 having two coaxial cams 14 and 16 for operating the valve 12, a summation lever 20 coupled to followers 24,26 of the two cams 14 and 16, a control spring 40 acting on the summation lever 20 to urge one of the cam followers 26 into contact with the associated cam 16, and a valve actuating rocker 30 pivotably connected to the summation lever 20 and acting on the valve 12 to open and close the valve in dependence upon the sum of the instantaneous lifts of the two cams 14 and 16. The method comprises the steps of journaling the camshaft 18 in a carrier 50, securing the cam summation lever 20 to the carrier 50 by means of the control spring 40, and securing the carrier 50 to the engine cylinder head, the control spring 40 and the carrier 50 serving to maintain the position of the cam summation lever 30 during assembly such that the valve actuating rocker 30 is aligned correctly to engage with the valve 12.

9 Claims, 3 Drawing Sheets

ASSEMBLY OF A VALVE OPERATING SYSTEM INCORPORATING A CAM SUMMATION MECHANISM

This invention relates to a valve operating system for an internal combustion engine that uses two coaxial cams to actuate a valve by way of a summation mechanism. In particular, the invention is concerned with assembling such a valve operating system in a cylinder head and its adjustment.

BACKGROUND OF THE INVENTION

Examples of valve operating systems that incorporate a summation mechanism are shown in the Applicants' earlier EP 1417399, EP 2142768, EP 2257697 and EP 2242912 which are imported herein by reference. Cam summation mechanisms need to have a clearance between at least one of the cam followers and its associated cam at some points in the camshaft rotation cycle, and it is known to provide a control spring to hold the summation lever in contact with one of the cam profiles so that its position is fully defined when there is clearance in the system. The amount of clearance needs to be adjusted in order to ensure that the valve lift is well matched between the different cylinders of the engine and to eliminate manufacturing tolerance variations in the various valvetrain components of the system, and variations in the cylinder head machining.

Conventional valvetrain systems also need to compensate for manufacturing variations and in many cases this is achieved by using a hydraulic lash adjuster that increases in length until the cam follower is held in contact with the cam lobe. Hydraulic lash adjusters have the advantages of allowing the system to compensate for temperature changes while the engine is running, compensating for any wear that occurs over the life of the engine, and eliminating the need for any manual adjustment of the system at the time of assembly.

A cam summation system using a hydraulic lash adjuster requires some form of stop in order to limit the expansion of the lash adjuster and to maintain the correct amount of clearance. In the absence of such a stop, the lash adjuster would continue to inflate until it has removed all of the clearance from the system. EP 1417399 shows a variety of different methods for maintaining and adjusting the amount of clearance in the system when a hydraulic lash adjuster is used.

FIGS. 5 and 6 of the latter patent show that the clearance can be controlled by setting the distance between the centre of the camshaft and the centre of the pivot shaft connecting the summation lever to the valve actuating rockers. Setting the distance between the centre of the camshaft and the centre of the pivot shaft is a particularly advantageous way of controlling the clearance because it still allows the hydraulic lash adjuster to compensate for the effects of thermal expansion in the cylinder head and to compensate for any variation in valve tip position due to tolerances, or due to wear over the life of the engine. Consequently, it is possible to adjust the clearance of the system as soon as a particular cam summation mechanism becomes associated with a particular group of cam lobes, and this adjustment can be completed before the system is fitted to the cylinder head.

Alternative designs to those disclosed in EP 1417399 have been proposed in order to achieve the same result by providing a cylindrical contact surface on the camshaft that contacts a corresponding surface either on the summation lever or on the valve actuating rocker(s).

A still further earlier proposal has been to rely on an eccentric pivot shaft or an eccentric cam follower axle as disclosed in FIGS. 4D and 5B of EP 2257697.

The method by which the clearance adjustment is achieved is not important to the present invention, which can be applied with any of the alternative designs discussed above.

The task of assembling of a complete valve operating system that incorporates a camshaft and one or more cam summation mechanisms is complicated because it is necessary to align each of several independently movable cam actuating rockers with a valve stem at one end and a pivot element, such as a lash adjuster, at the other as the camshaft is lowered into position. Furthermore, it is necessary to secure in position the control springs connected to the cam summation levers to urge the cam followers against their respective cam surfaces.

SUMMARY OF THE INVENTION

With a view to simplifying the above task, the present invention provides in accordance with a first aspect a method of assembling a valve operating system for opening and closing a poppet valve mounted on an engine cylinder head, the system comprising a camshaft having two coaxial cams for operating the valve, a summation lever coupled to followers of the two cams, a control spring acting on the summation lever to urge one of the cam followers into contact with the associated cam, and a valve actuating rocker pivotably connected to the summation lever and acting on the valve to open and close the valve in dependence upon the sum of the instantaneous lifts of the two cams, the method comprising the steps of journaling the camshaft in a carrier, securing the summation lever to the carrier by means of the control spring, and securing the carrier to the engine cylinder head, the control spring and the carrier serving to maintain the position of the cam summation lever during assembly such that the valve actuating rocker is aligned correctly to engage with the valve.

In accordance with a second aspect of the invention, there is provided a valve operating system for an engine valve mounted in a cylinder head, comprising two cams mounted coaxially on a camshaft, a summation lever coupled to followers of the two cams and movable in proportion to the instantaneous sum of the lifts of the respective cams, a valve actuating rocker pivotably coupled to the summation lever and operative to open the engine valve in dependence upon the movement of the summation lever and a control spring serving to urge one of the followers into contact with the associated cam, wherein a carrier is provided for supporting the camshaft, the summation lever and the valve actuating rocker in a suitable orientation for the valve actuating rocker to align correctly with the tip of the engine valve as the valve operating system is mated with the engine cylinder head, thereby enabling the valve operating system to be assembled to the engine cylinder head in a single operation.

BRIEF DESCRIPTION OF THE DRAWINGS

The invention will now be described further, by way of example, with reference to the accompanying drawings, in which.

DETAILED DESCRIPTION OF THE PREFERRED EMBODIMENTS

Figure 1:
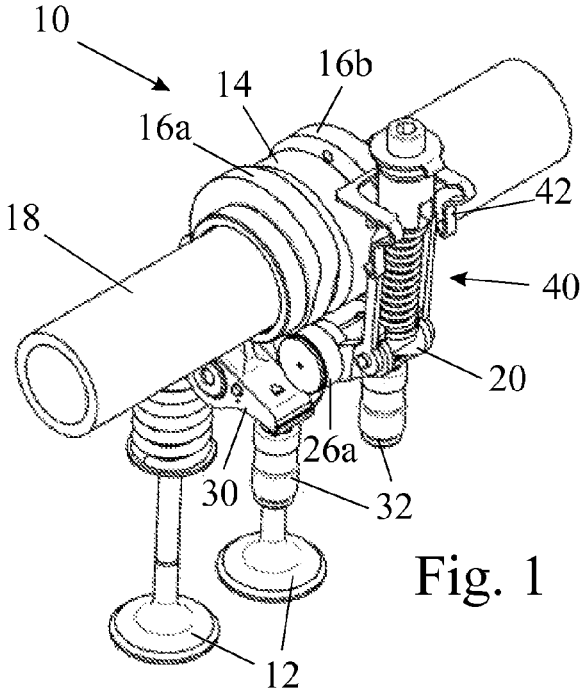
FIG. 1 is a perspective view of a valve operating system using two cams and a cam summation mechanism.

In FIG. 1, a valve operating system 10 is shown which acts in unison on two valves 12 mounted in an engine cylinder head (not shown). The valve operating system 10 comprises two cams 14, 16 mounted coaxially on a common camshaft 18. For the purpose of force balancing and creating an arrangement that is symmetrical, the cam 16 is formed in two halves 16*a* and 16*b* that have identical profiles and straddle the first cam 14. The purpose of using two cams to act on the same engine valve 12 is that it enables the lift and duration of the valve event to be changed by rotating the cams relative to one another.

Figure 2:
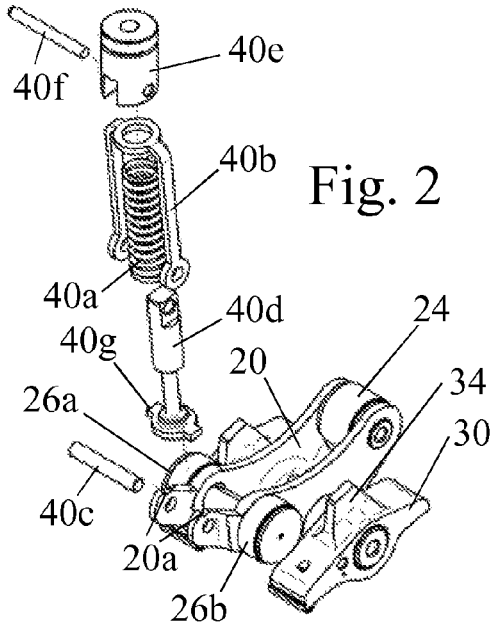
FIG. 2 is an exploded perspective view of the cam summation mechanism of FIG. 1.

The cams 14 and 16 act on the valves 12 by way of a cam summation mechanism shown in an exploded view in FIG. 2. The cam summation mechanism comprises a summation lever 20 that is coupled to three cam follower rollers 24, 26*a* and 26*b*. The single roller 24 is associated with the cam 14 and the two rollers 26*a* and 26*b* are associated with the cams 16*a* and 16*b*. In this way, the pivot axis of the summation lever 20 moves in proportion to the sum of the instantaneous lifts of the two cams 14 and 16.

Two valve actuating rockers 30 are pivotably mounted one on each side of the summation lever 20. Each actuating rocker 30 acts at one end on a respective one of the two valves 12 and rests at its other end on one of two hydraulic lash adjusters 32. The actuating rockers 30 have spacer shims 34, which may be formed separately from the rockers 30. The shims 34 maintain a minimum distance between the axis of the rockers 30 and the centre of camshaft 18 by contacting a cylindrical surface on the camshaft 18 when pushed upwards by the lash adjusters 32. In this way, the shims 34 set the clearance between the cam follower 24 and its associated cam 14 when either of the cam followers are on the base circle of their cams and the associated valves 12 are fully closed.

A control spring assembly 40 is connected between a cylinder head cover 50 (see FIG. 3) and one end of the summation lever 20 to pull the end of the lever 20 causing the rollers 26 to contact the cams 16 and creating a clearance between the roller 24 and the cam 14. Because tension springs are less reliable than compression springs, the spring assembly 40, as better shown in the exploded view of FIG. 2, uses a compression spring 40*a* of which the upper end exerts an upwards force (as viewed) on the summation lever 20 by way of an outer coupling element 40*b* that straddles the spring 40*a* and is connected to the summation lever 20 by a pin 40*c*. The spring 40*a* is compressed between the outer coupling element 40*b* and an inner coupling element 40*d* of which the upper end is connected by a pin 40*f* to a plunger 40*e* which, when the operating system is fully assembled, is retained in a bore in an engine cover 50. In this way, the lower end of the spring 40*a* is fixed in relation to the engine and the upper end acts upwards on the summation lever 20 to emulate the action of a tension spring.

Figure 3:
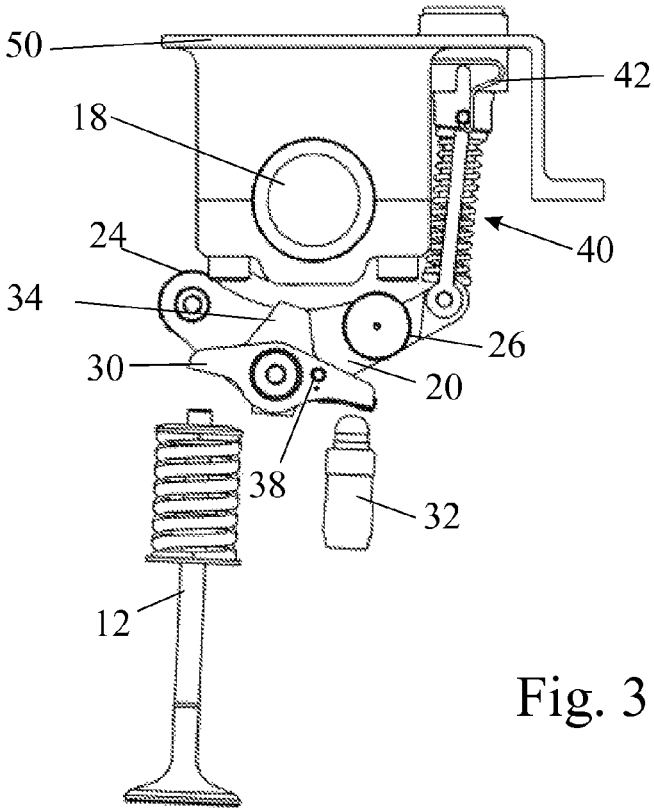
FIG. 3 is an end view showing the required relative positions of the components of the valve operating system during assembly.

FIG. 3 shows an end view of the cover 50 in which the camshaft 18 is journalled and having one or more summation mechanisms assembled to it. The clearance within this assembly can be adjusted before it is fitted to the cylinder head provided that summation mechanism remains associated with a particular group of cam lobes. During assembly, each summation mechanism is temporarily held in place by a clip 42 holding it to the engine cover 50 so that it will remain attached after the clearance adjustment process has been completed.

In order to fit the cover 50 to the top of the cylinder head, the rocker orientation needs to be accurately defined such that the valve actuating rockers 30 on all cylinders of the engine will engage with their respective hydraulic lash adjusters 32 and valves 12 as the cover 50 is lowered vertically into position.

It can be appreciated from FIG. 3 that the illustrated desired position of the summation mechanism is not the one that the various components would naturally adopt under the influence of gravity. Rather, the pivoting joints at each end of the control spring assembly 40 would naturally rotate such that the centre of mass of the summation mechanism would lie below the retaining clip 42 holding the plunger 40*e* in the cover 50.

In the illustrated embodiments of the invention, steps are taken to ensure that the cam summation mechanism automatically adopts the correct orientation to align the valve actuating rockers 30 with the valves 12 and the lash adjusters 32 as the cover assembly 50 is lowered into position to mate with the cylinder head.

In order to position the summation mechanism correctly, it is necessary to control the orientation of the pivot joints at both ends of the control spring assembly. In the embodiment of the invention shown in FIGS. 1 to 5, the position of the summation mechanism is determined by the design of the inner and outer coupling elements 40*d* and 40*b* of the control spring assembly 40.

Figure 4:
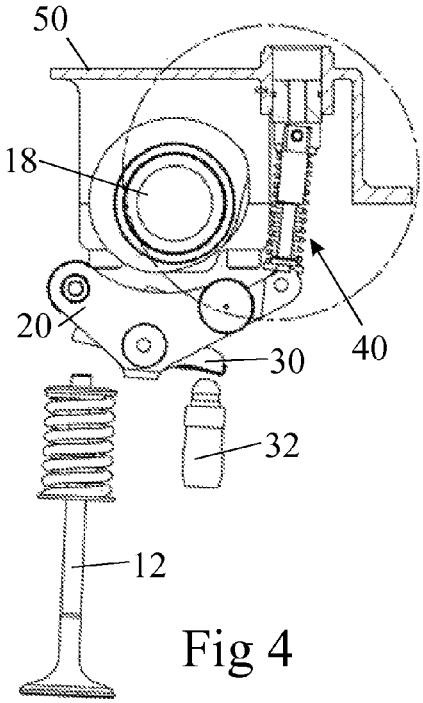
FIG. 4 is a section through the valve operating system of FIG. 3 passing through the centre of the control spring, FIG. 4*a* a detail of FIG. 4 contained within a dotted circle drawn to an enlarged scale.
Figure 4A:
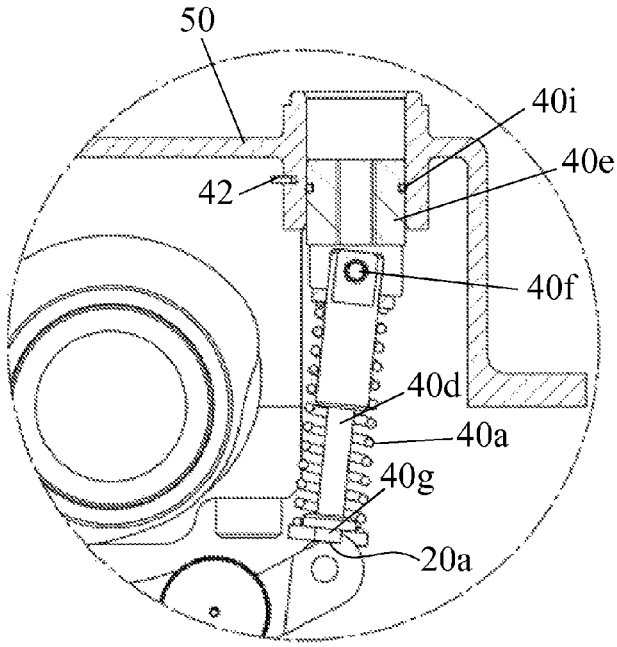

FIGS. 3, 4 and 4*a* illustrate the position that the coupling elements will take up when the spring 40*a* is allowed to expand freely. The outer coupling element 40*b* is moved upwards by the spring 40*a* until it contacts an angled lower face of the plunger 40*e* that locates the summation mechanism in the engine cover. Although, the upper end of the outer coupling element 40*b* is contacting the lower face of the plunger 40*e*, it may still pivot about its connection pin 40*f*, although in order to do so it must compress the control spring 40*a*. Hence the spring 40*a* will act to bias the pivot joint towards the position shown in FIGS. 3, 4 and 4*a*.

At the lower end of the control spring assembly 40, the inner coupling element 40*d* has a pair of locating tags 40*g* that engage with stop shoulders 20*a* machined on the summation lever 20 and locate the summation lever in the position shown in FIGS. 3 and 4 under the action of gravity. The stop shoulders 20*a* on the summation lever 20 remain outside of the normal range of working positions and may move out of contact with the tags 40*g* as the summation lever moves towards its assembled position.

Thus, as the cam summation mechanism comes into contact with the hydraulic lash adjuster 32 and the tip of the valve 12, and as the engine cover 50 is located into its final position relative to the cylinder head, the summation mechanism is able to move to the correct position within its working range of motion. However in the free state, it will always move back to the assembly position shown in FIGS. 3 and 4 under the action of gravity and the control spring 40*a*.

It is also necessary to control the orientation of the valve actuating rockers 30 with respect to the summation lever 20 during assembly to make sure that the correct features will engage with the valve 12 and the hydraulic lash adjuster 32. This is achieved simply in the illustrated embodiment by a pin 38 engaged with a flat or a hole in the summation lever 20 rocker as shown in FIG. 3. In this way the valve actuating rocker 30 is restricted to a range of rotation angles slightly larger than its working range.

Figure 5:
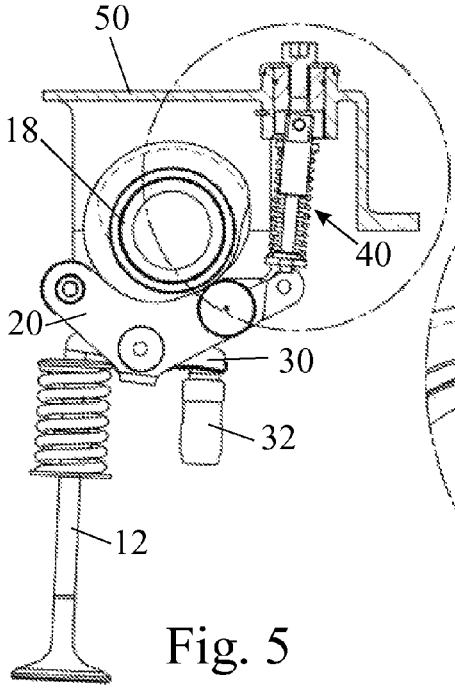
FIG. 5 is a section similar to that of FIG. 4 after completion of the assembly.
Figure 5A:
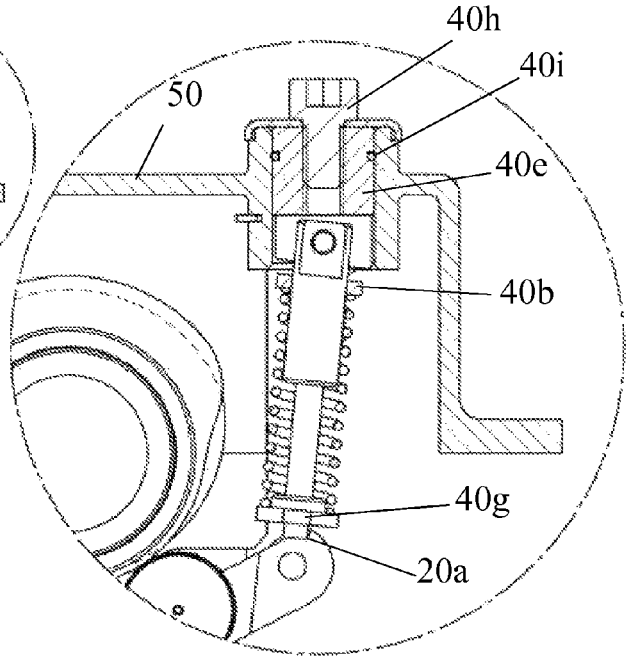
FIG. 5*a* is a detail of FIG. 5 drawn to an enlarged scale.

Once the engine cover has been secured in place, as shown in FIG. 5, the final assembly operation is to tension the control spring assembly 40 such that it will maintain contact between one of the cam lobes and its followers. This is achieved by securing a fixing screw 40*h* into the top of the plunger 40*e* such that the plunger is held at the top of its bore in the engine cover. An oil seal 40*i* is located around the plunger 40*e*, as shown, if it is necessary to prevent leakage around its outer surface.

Tensioning the control spring 40*a* has the effect of pulling the top face of the outer coupling element 40*b* away from the angled flat on the underside of the plunger 40*e*, and pulling the tags 40*g* on the lower end of the inner coupling element 40*d* out of engagement with the stop shoulders 20*a* on the summation lever 20. These location features are now unable to make contact with each other under any circumstances whilst the rocker system is operating. The tensioned control spring assembly 40 is therefore able to pivot freely about its connection pins 40*c* and 40*f*.

If the valve operating system is disassembled, the removal of the fixing screw 40*h* from the top of the plunger 40*e* will allow the control spring 40*a* to expand, re-engaging the location features. Hence as the engine cover is removed with the camshaft 18 and the summation mechanisms from the cylinder head, the summation levers and valve actuating rockers will naturally return to their assembly position under the action of the return spring and the force of gravity.

Figure 6:
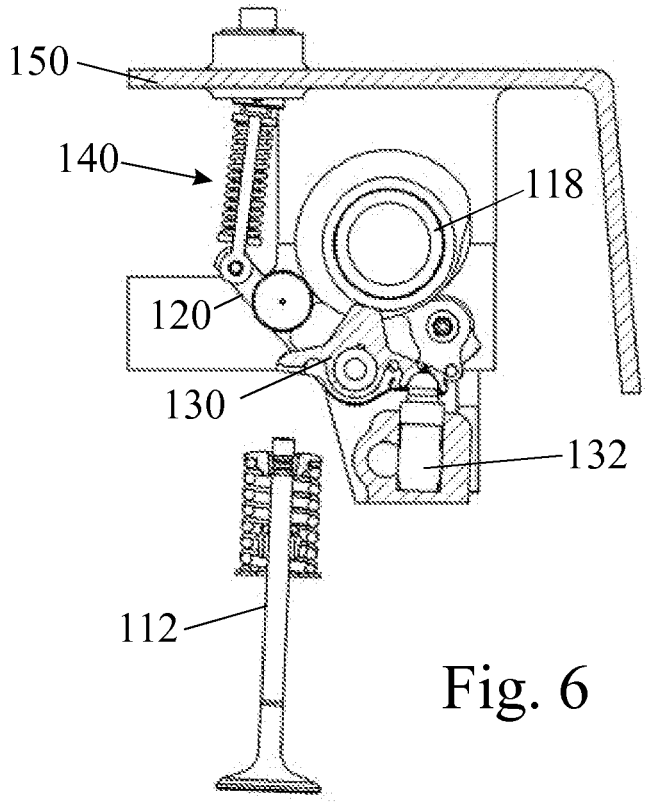
FIG. 6 is a view similar to that of FIG. 4 of an alternative embodiment of the invention showing a section passing through the plane of the valve actuating rocker.
Figure 7:
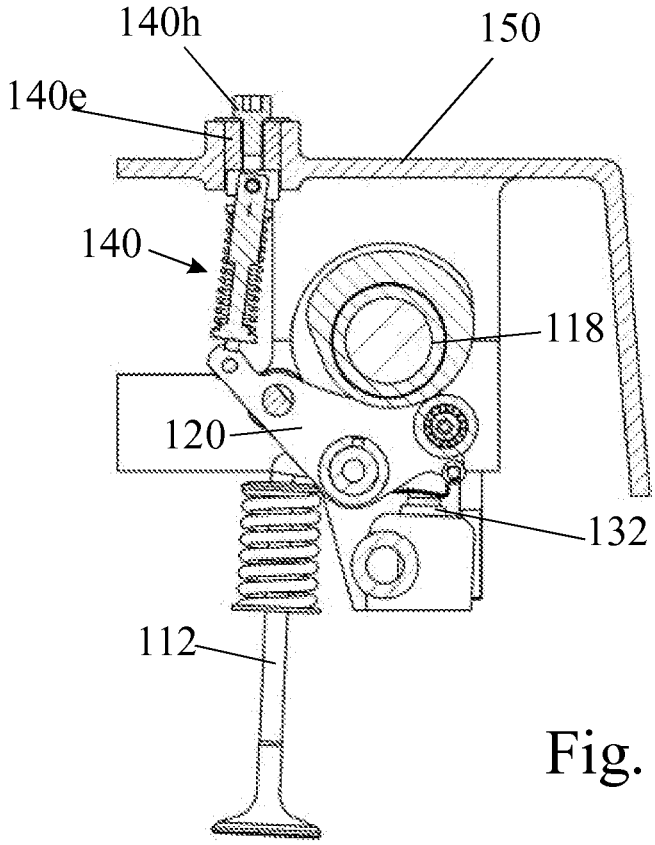
FIG. 7 is a view similar to that of FIG. 5 showing the embodiment of the invention of FIG. 6 in its assembled state.

An alternative embodiment of the invention is shown in FIGS. 6 and 7. In describing this embodiment, components equivalent to those described in connection with the first embodiment have been allocated like reference numerals but in the 100 series. In this embodiment, instead of being mounted in a cylinder head cover, the camshaft 118 and the cam summation mechanism are assembled into a camshaft carrier that includes mounting bores for the hydraulic lash adjusters 132. Because each summation lever 120 is located on one side by the control spring assembly 140 and on the other side by a lash adjuster 132, its valve actuating rockers 130 will always be in a position to engage with the tips of the engine valves 112 as the camshaft carrier 150 is secured into place inside the cylinder head.

As with the previous embodiment, the plunger 140*e* is used to secure the top of the control spring assembly 140 to the carrier 150. This plunger 140*e* may again be loosely retained in its bore using a clip, as shown in the previous embodiment, the fixing screw 140*h* being secured into the plunger 140*e* to tension the spring 140*a* only after the camshaft carrier has been secured to the head. In this embodiment, the plunger fixing screw 140*h* may alternatively be secured in position before the carrier is assembled to the cylinder head, such that the force of the control spring assembly 140 acts to hold the cam summation mechanism firmly in contact with the camshaft 118.

It would further be possible to machine the hydraulic locating bores for the lash adjusters 132 such that they pass completely through the camshaft carrier 150 and the base of the hydraulic lash adjusters 132 sit on a machined surface in the cylinder head. This would result in the position of the hydraulic lash adjuster perpendicular to its axis being defined by the camshaft carrier and its axial position being defined by the cylinder head.

In such a design of camshaft carrier 150, the action of gravity and the control spring assembly 140 would tend to cause the hydraulic lash adjusters to sit lower in their locating bores than their finally assembled position, which they would take up when the camshaft carrier is secured to the cylinder head. It is therefore possible to use the operation of assembling the camshaft carrier to the cylinder head for increasing the preload on the control spring to the required level for the rocker system to operate correctly.

An important feature of both described embodiments is that they offer the potential of integrating the camshaft and rocker system into a pre-adjusted sub assembly that can be produced in isolation from the cylinder head/engine to which it is fitted. As the camshaft may be mounted directly into the engine cover or the camshaft carrier, there is no need to machine this part as an assembly with the cylinder head—a flat mating face on the cylinder head is all that is required to secure the assembly into position. This significantly reduces the complexity of the cylinder head casting and its subsequent machining process.

The invention claimed is:

1. A method of assembling a valve operating system for opening and closing a poppet valve mounted on an engine cylinder head, the system having a carrier, a camshaft having an axis, at least two coaxial cams rotatable about the camshaft axis, at least two cam followers, each associated with a corresponding cam, a summation lever coupled to the followers, a control spring acting on the summation lever to urge one of the cam followers into contact with the associated cam, and a valve actuating rocker acting on the valve to open and close the valve in dependence upon the sum of the instantaneous lifts of the two cams, the valve actuating rocker being pivotably connected to the summation lever and pivoted about a hydraulic lash adjuster, the method comprising the steps of:

journaling the camshaft in a carrier;

tensioning the summation lever towards the carrier by coupling the control spring between the carrier and the summation lever: and securing the carrier to the engine cylinder head, the control spring and the carrier serving to maintain the position of the cam summation lever during assembly such that the valve actuating rocker is aligned to engage with the valve and the hydraulic lash adjuster.

2. The method of claim 1, wherein the control spring comprises a compression spring.

3. A valve operating system for operating an engine valve mounted in a cylinder head of an engine, the system comprising:

a carrier:

a camshaft supported by the carrier and having an axis:

at least two cams rotatable about the camshaft axis;

at least two cam followers, each associated with a corresponding cam;

a summation lever coupled to the followers and movable in proportion to the instantaneous sum of the lifts of the respective cams;

a valve actuating rocker pivotably coupled to the summation lever and operative to open the engine valve in dependence upon the movement of the summation lever; and a control spring acting between the summation lever and the carrier to urge at least one of the followers into contact with the associated cam;

wherein when the system is operably coupled to the engine cylinder head:

the valve actuating rocker is pivoted about a hydraulic lash adjuster;

the control spring is being connected to the carrier in a manner to pull the valve actuating rocker away from the lash adjuster; and wherein the carrier supports the camshaft, the summation lever and the valve actuating rocker in an orientation for the valve actuating rocker to align with the tip of the engine valve and the lash adjuster as the valve operating system is mated with the engine cylinder head.

4. A valve operating system as claimed in claim 3, comprising an adjustment mechanism for tensioning the control spring after assembly of the carrier, the camshaft and the summation mechanism to the engine.

5. A valve operating system as claimed in claim 3, wherein the control spring couples the summation level and the carrier via at least one pivotable joint.

6. A valve operating system as claimed in claim 5 further comprising a stop, and wherein the angular rotation of the pivoting joint is restricted by the stop during assembly, the stop lying outside the assembled angular range of the pivot joint after assembly of the valve operating system to the cylinder head.

7. A valve operating system of claim 3, further comparison a pin to restrict the range of angular rotation of the valve actuation rocker with respect to the summation lever.

8. A valve operating system claim 3, wherein clearance in the valve operating system is settable prior to the fitting of the valve operating system to the engine.

9. A valve operating system as claimed in claim 8, wherein the control spring is capable of being fully compressed to its assembled position prior to the valve operating system being fitted to the cylinder head.

* * * * *